US007682171B2

(12) United States Patent
Hwang

(10) Patent No.: US 7,682,171 B2
(45) Date of Patent: Mar. 23, 2010

(54) CONNECTOR FOR AUTOMOTIVE AUDIO SYSTEM

(75) Inventor: Jin Man Hwang, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 12/082,288

(22) Filed: Apr. 9, 2008

(65) Prior Publication Data

US 2009/0130886 A1 May 21, 2009

(30) Foreign Application Priority Data

Nov. 16, 2007 (KR) ..... 10-2007-0117468

(51) Int. Cl.
*H01R 3/00* (2006.01)

(52) U.S. Cl. ..... 439/165; 439/297; 411/161

(58) Field of Classification Search ..... 439/534, 439/131, 171, 173, 640, 165, 297; 411/160–165
See application file for complete search history.

(56) References Cited

U.S. PATENT DOCUMENTS 6,141,831 A * 11/2000 Novin et al. ..... 16/330
6,859,978 B2 * 3/2005 Pan ..... 16/292
2004/0131443 A1 * 7/2004 Terry ..... 411/161

* cited by examiner

*Primary Examiner*—Edwin A. Leon
*Assistant Examiner*—Larisa Tsukerman
(74) *Attorney, Agent, or Firm*—Edwards Angell Palmer & Dodge LLP; Peter F. Corless

(57) ABSTRACT

A connector for an audio system of a vehicle is disclosed. The connector comprises: a connector body, which is to be connected with a connecting terminal of an automotive circuit board of the vehicle; a first rotating shaft, which has a first washer and is fixed on one side of the connector body; a second rotating shaft, which has a second washer, which is to be engaged with the first washer, and is fixed to the audio system; and an elastic member disposed between the first washer and the second washer.

2 Claims, 5 Drawing Sheets

CONNECTOR FOR AUTOMOTIVE AUDIO SYSTEM

CROSS-REFERENCE TO RELATED APPLICATIONS

This application claims priority to Korean Application No. 10-2007-0117468, filed on Nov. 16, 2007, the entire disclosure of which is incorporated herein by reference.

BACKGROUND

1. Technical Field

The present invention relates to a connector for a vehicle audio system which is connected to the circuit board of a vehicle.

2. Background Art

In a vehicle, an audio system is connected to various control units using a connector. This audio system connector is directly fixed to a circuit board. The audio system connected to the audio system connector is mounted at a preset position.

However, the audio system connector is fixed to the audio system in one direction, and thus there are limitations on the mounting angle and orientation of an audio system when it is mounted in a vehicle.

Further, when a specification is changed based on a change in the mounting position or the layout of the audio system, the wiring route must be changed, or a new chassis supporting the circuit board of the vehicle must be made.

The information disclosed in this Background section is only for enhancement of understanding of the background of the invention and should not be taken as an acknowledgement or any form of suggestion that this information forms the prior art that is already known to a person skilled in the art.

SUMMARY OF THE DISCLOSURE

Accordingly, the present invention has been made keeping in mind the above problems occurring in the prior art, and an object of the present invention is to at least provide a connector for a vehicle audio system, which can connect the audio system to the circuit board of a vehicle at various angles.

In order to achieve the above object, according to one aspect of the present invention, there is provided a connector for an audio system for a vehicle, which comprises a connector body, a first rotating shaft fixed to the connector body, a second rotating shaft fixed to the audio system, and an elastic member. The connector body is adapted to be connected with a connecting terminal of a circuit board of the vehicle. The first rotating shaft includes a first washer, the second rotating shaft includes a second washer, and the second washer is capable of engaging with the first washer. The elastic member is disposed between the first washer and the second washer.

Preferably, the first rotating shaft further includes a first rotating bar which has an insertion hole therein and is fixed to the connector body at one end thereof; the first washer has at least one first locking tongue on an outer circumference thereof and is fixedly mounted to one end of the first rotating bar, the second rotating shaft further includes a second rotating bar one end of which is fixed to the audio system and at least one portion of which is inserted into the insertion hole of the first rotating bar; and the second washer which has at least one second locking tongue on an outer circumference thereof and is fixedly mounted to an intermediate part of the second rotating bar.

Also preferably, the first locking tongue each has an inclined face and protrudes toward the second locking tongue.

Suitably, when the first rotating shaft is rotated by pressing, the first locking tongue is engaged with the second locking tongue so that the elastic member is compressed.

With the structures, the connectors for a vehicle audio system can enable the audio system to be connected to a circuit board of the vehicle at various angles thus improving the assemblability of a product is. Further, the present connectors have various layouts due to the rotatability thereof, so that the wiring route can be easily changed when a specification is changed due to a change in the mounting position or the layout of the automotive audio system.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like.

Other features of the invention are discussed infra.

BRIEF DESCRIPTION OF THE DRAWINGS

The above and other features of the present invention will now be described in detail with reference to certain exemplary embodiments thereof illustrated the accompanying drawings which are given hereinbelow by way of illustration, and thus are not limitative of the present invention, and wherein.

Figure 1:
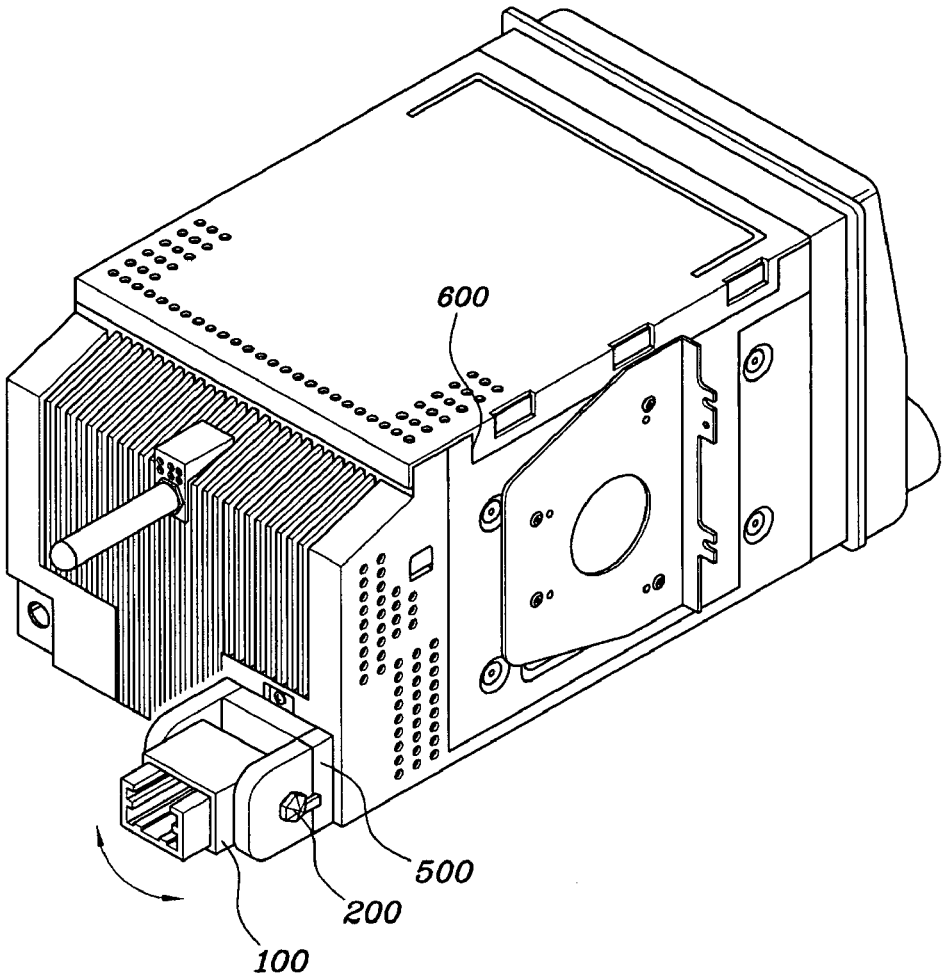
FIG. 1 is a perspective view illustrating a connector for an automotive audio system according to a preferred embodiment of the present invention.
Figure 2:
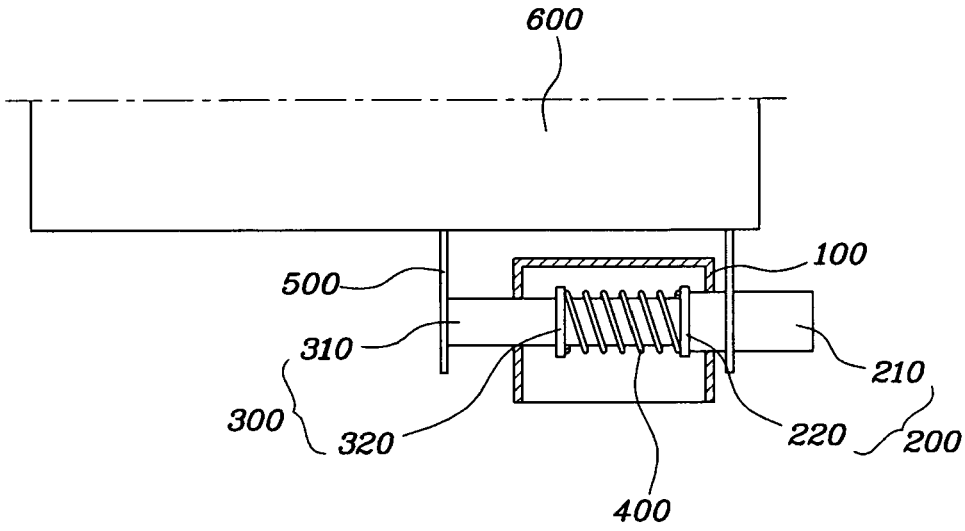
FIG. 2 is a view illustrating the configuration of a connector for an automotive audio system according to a preferred embodiment of the present invention.
Figure 3:
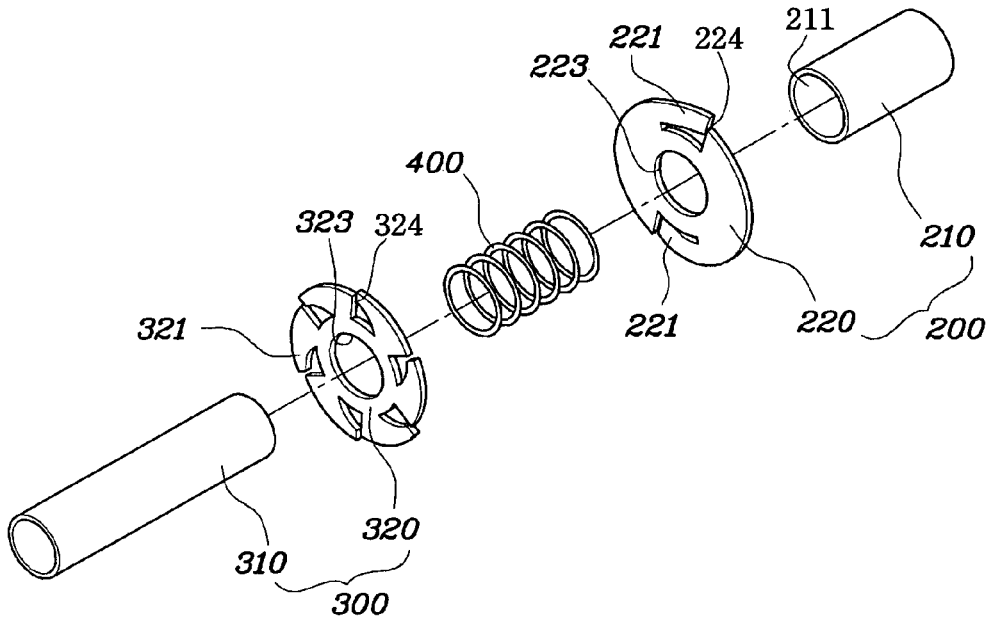
FIG. 3 is an exploded perspective view illustrating the relationship between first and second rotating shafts of a connector for an automotive audio system according to a preferred embodiment of the present invention.
Figure 4A:
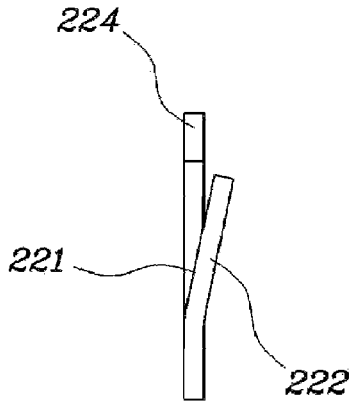
FIG. 4A is a side view showing a first washer according to a preferred embodiment of the present invention.
Figure 4B:
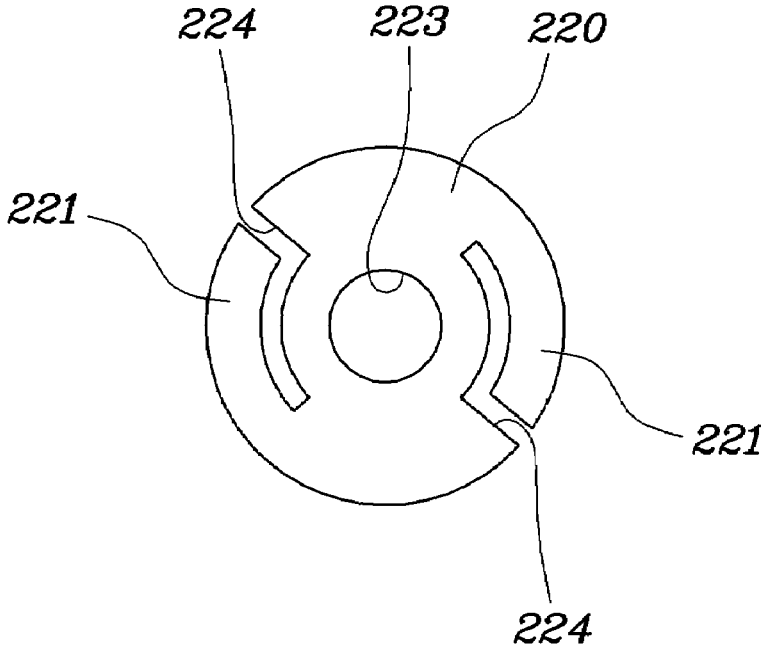
FIG. 4B is a plan view showing a first washer according to a preferred embodiment of the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment. In the figures, reference numbers refer to the same or equivalent parts of the present invention throughout the several figures of the drawing.

DETAILED DESCRIPTION

Reference will now be made in detail to a preferred embodiment of the present invention, an example of which is illustrated in the accompanying drawings and described below. While the invention will be described in conjunction with an exemplary embodiment, it should be understood that the description is not intended to limit the invention to the exemplary embodiment. On the contrary, the invention is intended to cover not only the exemplary embodiment, but also various alternatives, modifications, equivalents and other embodiments, which may be included within the spirit and scope of the invention as defined by the appended claims.

As illustrated in FIGS. 1 through 4, the connector for a vehicle audio system according to a preferred embodiment of the present invention comprises a connector body 100, a first rotating shaft 200, which includes a first washer 220 and is fixed on one side of the connector body 100, a second rotating shaft 300, which includes a second washer 320 and is fixed to an audio system 600, and an elastic member 400, which is disposed between the first washer 220 and the second washer 320.

Specifically, the connector body 100 electrically interconnects the audio system 600 and the connecting terminal (not shown) of a vehicle circuit board in order to electrically connect the audio system 600 with a vehicle. The electrical interconnections between the audio system 600 and the connector body 100 and between the connector body 100 and the connecting terminal are conventional such as of using a plug and/or socket (not shown) and, thus, the detailed drawing of a wiring which shows the electric interconnections is omitted. The first rotating shaft 200 is fixedly installed on one side of the connector body 100.

The first rotating shaft 200 functions to rotate the connector body 100. To this end, the first rotating shaft 200 includes a first rotating bar 210, which is fixed to the connector body 100, and the first washer 220, which is mounted on the first rotating bar 210. The first rotating bar 210 is provided with an insertion hole 211, into which the second rotating shaft 300 is inserted, at one end thereof. The other end of the first rotating bar 210 is fixed to the connector body 100 and an intermediate part of the first rotating bar 210 is rotatably and slidably engaged with a support bracket 500 which is mounted on a rear side of the audio system.

The first washer 220 is fixedly mounted around the first rotating bar 210 via a through hole 223, and is provided with at least one first locking tongue 221 each having an inserting slot 224 on an outer circumference thereof. Each of the first locking tongues 221 has an inclined face 222 and protrudes. With this configuration, the first locking tongue(s) 221 can be smoothly connected with the second locking tongue(s) 321.

The first and second locking tongues define a space in which the elastic member 400 is compressed between the first washer 220 and the second washer 320.

The second rotating shaft 300 is fixedly installed on the audio system 600. This second rotating shaft 300 functions to rotate the connector body 100 in cooperation with the first rotating shaft 200.

To this end, the second rotating shaft 300 includes a second rotating bar 310 and the second washer 320. One end of the second rotating bar 310 is fixed to the audio system 600 through the support bracket 500 which is mounted on a rear side of the audio system. The other end of the second rotating bar 310 is inserted into the insertion hole 211 of the first rotating bar 210.

The second washer 320 is fixedly mounted around the intermediate part of the second rotating bar 310 through a second through-hole 323. The second washer 320 is provided with at least one second locking tongue 321 each having an inserting slot 324 on an outer circumference thereof. Each of the second locking tongues 321 has an inclined face and protrudes toward the corresponding first locking tongue 221.

The elastic member 400 is disposed between the first washer 220 and the second washer 320, and is supported between the first rotating shaft 200 and the second rotating shaft 300 in an axial direction. This elastic member 400 may use an ordinary coil spring.

The operation of the connector according to a preferred embodiment of the present invention will be described below.

Figure 5A:
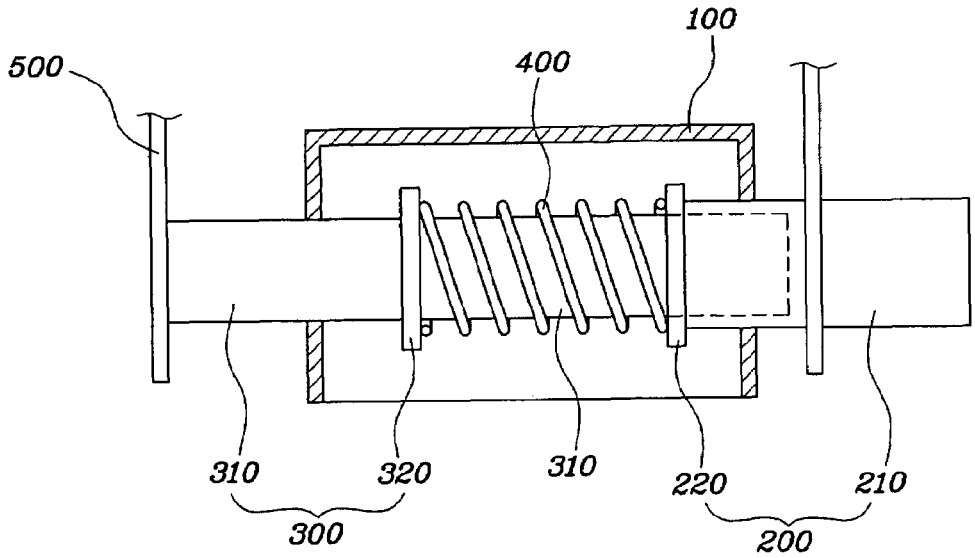
FIGS. 5A and 5B are views illustrating the states before and after the operation of a connector for an automotive audio system according to a preferred embodiment of the present invention.

As illustrated in FIG. 5A, when a user rotates the first rotating shaft 200 while pressing the first rotating shaft 200 toward the second rotating shaft 300, the first rotating bar 210 is rotatably fitted around the second rotating shaft 300 through the insertion hole 211, thus compressing the elastic member 400. Thereby, the first locking tongues 221 are engaged with and fixed to the second locking tongues 321.

At this time, the connector body 100, which is fixedly connected to the first rotating shaft 200, can be rotated with respect to the automotive system 600 at a predetermined angle in a counterclockwise direction. The user can selectively adjust the rotating angle of the connector body 100 in a manner such that the rotating angle of the first locking tongues 221 is adjusted to correspond to the rotating angle of the second locking tongues 321.

Figure 5B:
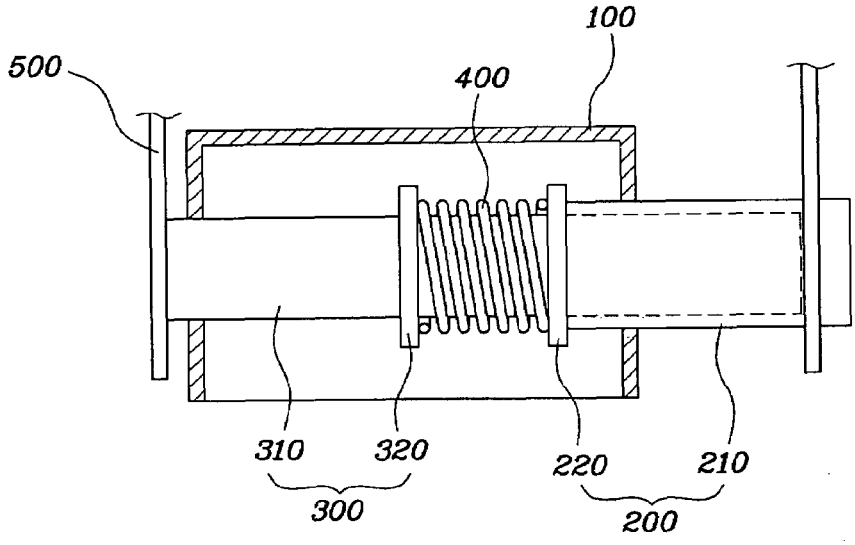

As illustrated in FIG. 5B, when the user rotates the first rotating shaft 200 in a clockwise direction, the first locking tongues 221 are released from the second locking tongues 321, and thus the elastic member 400 is released. At this time, the connector body 100, which is fixedly connected to the first rotating shaft 200, can be rotated with respect to the automotive audio system 600 at a predetermined angle in a clockwise direction.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A connector for an audio system of a vehicle, comprising:

a connector body being connected with the audio system via a bracket mounted on a rear side of the audio system;

a first rotating shaft including a first rotating bar which has an insertion hole therein and is fixed to the connector body at one end thereof and a first washer having at least one first locking tongue on an outer circumference thereof and is fixedly mounted to the first rotating bar;

a second rotating shaft including a second rotating bar one end of which is fixed to the audio system via the bracket and at least one portion of which is rotatably inserted into the insertion hole of the first rotating bar and a second washer having at least one second locking tongue on an outer circumference thereof and is fixedly mounted to an intermediate part of the second rotating bar and is capable of engaging with the first washer; and an elastic member disposed between the first washer and the second washer, wherein, when the first rotating shaft is rotated by pressing, the first locking tongue is engaged with the second locking tongue so that the elastic member is compressed.

2. The connector according to claim 1, wherein the first locking tongue each has an inclined face and protrudes to be engaged with the second locking tongue.

* * * * *